US010160234B2

(12) United States Patent
Komuro et al.

(10) Patent No.: US 10,160,234 B2
(45) Date of Patent: Dec. 25, 2018

(54) RECORDING APPARATUS

(71) Applicant: SEIKO EPSON CORPORATION, Tokyo (JP)

(72) Inventors: Shintaro Komuro, Nagano (JP); Tetsuji Yatsunami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/909,041

(22) Filed: Mar. 1, 2018

(65) Prior Publication Data

US 2018/0272755 A1 Sep. 27, 2018

(30) Foreign Application Priority Data

Mar. 22, 2017 (JP) ..... 2017-055971

(51) Int. Cl.

| | |
|---|---|
| ***B65H 5/24*** | (2006.01) |
| ***B65H 29/66*** | (2006.01) |
| ***B41J 11/00*** | (2006.01) |
| ***B65H 5/06*** | (2006.01) |
| ***B65H 7/12*** | (2006.01) |
| ***B41J 13/00*** | (2006.01) |

(52) U.S. Cl.

CPC ..... *B41J 11/006* (2013.01); *B41J 11/0095* (2013.01); *B41J 13/0009* (2013.01); *B41J 13/0018* (2013.01); *B41J 13/0027* (2013.01); *B65H 5/062* (2013.01); *B65H 5/24* (2013.01); *B65H 7/12* (2013.01); *B65H 29/6609* (2013.01); *B65H 2513/53* (2013.01); *B65H 2601/255* (2013.01); *B65H 2701/1311* (2013.01)

(58) Field of Classification Search

CPC ..... B41J 13/0009; B41J 13/0018; B41J 13/0027; B41J 11/0095; B65H 5/24; B65H 29/6609; B65H 2701/1311; B65H 2513/53

See application file for complete search history.

(56) References Cited

U.S. PATENT DOCUMENTS

| | | | | |
|---|---|---|---|---|
| 9,333,773 | B2 * | 5/2016 | Taniguchi | B41J 13/0009 |
| 9,956,793 | B2 * | 5/2018 | Yatsunanni; Tetsuji | B41J 11/04 |
| 2001/0033389 | A1 | 10/2001 | Kurihara | |
| 2006/0187287 | A1 * | 8/2006 | Edwards | B41J 13/0027 347/104 |
| 2011/0076082 | A1 | 3/2011 | Ouchi | |
| 2015/0251865 | A1 | 9/2015 | Nishida et al. | |
| 2015/0352866 | A1 | 12/2015 | Tanaami et al. | |
| 2017/0282606 | A1 | 10/2017 | Yatsunami et al. | |
| 2017/0282609 | A1 | 10/2017 | Yatsunami | |

FOREIGN PATENT DOCUMENTS

| | | | |
|---|---|---|---|
| JP | 2001-301282 | A | 10/2001 |
| JP | 2010-271405 | A | 12/2010 |
| JP | 2011-073841 | A | 4/2011 |
| JP | 2015-168237 | A | 9/2015 |
| JP | 2015-229555 | A | 12/2015 |
| JP | 2017-177617 | A | 10/2017 |
| JP | 2017-177618 | A | 10/2017 |
| JP | 2017-177619 | A | 10/2017 |
| JP | 2017-177620 | A | 10/2017 |
| JP | 2017-178569 | A | 10/2017 |
| JP | 2017-178570 | A | 10/2017 |

* cited by examiner

*Primary Examiner* — Luis A Gonzalez

(57) ABSTRACT

A recording apparatus which is capable of suppressing or avoiding a concern on a defect such as a paper jam, deterioration of recording quality, or the like at the time of performing an overlapping transportation is provided.

11 Claims, 10 Drawing Sheets

RECORDING APPARATUS

BACKGROUND

1. Technical Field

The present invention relates to a recording apparatus which performs recording on a medium.

2. Related Art

In a recording apparatus representing an ink jet printer (hereinafter, simply referred to as a printer), in order to improve a throughput of a recording process, that is, to increase the number of sheets to be recorded per unit time, an "overlapping transportation" in which mediums are transported to a recording region of a recording head is performed in a state in which a trailing end of a preceding medium, which is precedently transported, and a leading end of a following medium are overlapped with each other (for example, refer to JP-A-2015-168237).

In a case in which the "overlapping transportation" is performed in JP-A-2015-168237, a transporting position of the preceding medium or the following medium is grasped based on a detected result of a medium performed by a detecting sensor 16 provided on an upstream side of a recording head 7, the following medium catches up with the preceding medium in front of a transporting roller 5 by controlling the transportation of the following medium, and thus the leading end of the following medium is overlapped with the trailing end of the preceding medium.

However, when a transportation accuracy of the medium is changed due to the types or differences of thicknesses of mediums being transported, an influence of a condition for using a printer (temperature, humidity, or the like), and the like, a defect as follows may be generated. For example, when an actual amount of transportation of the following medium is smaller than a planned amount of transportation thereof, an amount of an overlapped part between the trailing end of the preceding medium and the leading end of the following medium (hereinafter, refer to as an amount of being overlapped) becomes small. When the amount of being overlapped becomes small, there is a concern on generation of a defect that the trailing end of the preceding medium and the leading end of the following medium may collide with each other so that a paper jam may be generated or the overlapped part between the preceding medium and the following medium may be reversed upside down.

In addition, when the actual amount of transportation of the following medium is much more than the planned amount of transportation, there is a concern that the leading end of the following medium which is required to stop in front of the transporting roller 5 at the time of performing recording on the preceding medium may be nipped between the transporting roller 5 and a pinching roller 6. Accordingly, an unexpected "overlapping transportation" is performed before the recording on the preceding medium is finished, a distance between the recording head 7 and the medium is shortened, and thus there is a concern that friction between the recording head 7 and the medium may be generated or contents which originally need to be recorded on the preceding medium may be recorded on the following medium.

SUMMARY

An advantage of some aspects of the invention is to provide a recording apparatus which is capable of suppressing or avoiding a concern on a defect such as a paper jam or deterioration of a recording quality at the time of performing an "overlapping transportation".

According to an aspect of the invention, there is provided to a recording apparatus including a transporting portion that transports a medium, a recording portion that is positioned on a downstream side of the transporting portion, and performs recording on the medium being transported, a first sensor that detects a position of an end portion of the medium in a transporting direction which is transported on an upstream side of the transporting portion, a second sensor that detects a position of an end portion of the medium in the transporting direction which is transported on an upstream side of the first sensor, and a controller that is capable of performing an overlapping transportation control including an overlapping operation in which a following medium catches up with a trailing end of a preceding medium which is precedently transported so as to be overlapped with each the trailing end of the preceding medium on the upstream side of the transporting portion, and a continuous-transporting operation in which the mediums are transported by the transporting portion in a state in which a leading end of the following medium is overlapped with the trailing end of the preceding medium, in which the controller acquires movement information relating to movement of a leading end of the preceding medium from a detection position detected by the second sensor to a detection position detected by the first sensor, and performs an overlapping transportation control based on the movement information.

The "preceding medium" in this specification is a medium being precedently transported, and the "following medium" is a medium being transported following the preceding medium. The "preceding medium" is not limited to the first sheet of medium after starting recording, and if the "preceding medium" is a second sheet of the medium after starting the recording, the "following medium" means a third sheet of the medium. In addition, as "the movement information relating to movement from the detection position detected by the second sensor to the detection position detected by the first sensor" of the leading end of the preceding medium, for example, there is a moving speed or a moving time from the detection position detected by the second sensor to the detection position detected by the first sensor of the leading end of the preceding medium.

Here, for example, when the following medium is transported at a predetermined distance or more, there is a concern on generation of a defect that the following medium may enter and be transported to the transporting portion so as to be overlapped before the recording on the preceding medium is finished. Meanwhile, when the transporting distance of the following medium is equal to or shorter than a predetermined distance, the amount of being overlapped of the trailing end of the preceding medium and the leading end of the following medium becomes small, and there is a concern that a defect such as a paper jam may be generated. According to the aspect, since the controller acquires the movement information relating to the movement from the detection position detected by the second sensor to the detection position detected by the first sensor of the leading end of the preceding medium, and performs the overlapping transportation control based on the movement information, the defect can be suppressed or avoided, and the throughput of the recording process can be improved by improving the frequency of the continuous-transporting operation.

In the recording apparatus, the controller may perform a non-overlapping transportation control in which the mediums are transported with an interval between the trailing end of the preceding medium and the leading end of the following medium without performing the overlapping transportation control in a case in which an amount of a margin of a trailing end side of the preceding medium is smaller than a reference amount of a margin which is set in advance.

In this case, since the controller does not perform the overlapping transportation control in a case in which the amount of a margin of the trailing end side of the preceding medium is smaller than the reference amount of a margin, which is set in advance, and performs the non-overlapping transportation control in which the mediums are transported with an interval between the trailing end of the preceding medium and the leading end of the following medium, it is possible to suppress a failure of the overlapping transportation control due to canceling of an unreasonable overlapping transportation control.

In the recording apparatus, the recording apparatus may further include an upstream side transporting portion that transpprts a medium to an upstream side of the second sensor, in which the controller drives the upstream side transporting portion so that the following medium is transported to a predetermined standby position on the upstream side of the transporting portion at the time of the overlapping operation.

In this case, in the recording apparatus which is provided with the upstream side transporting portion for transporting the medium on the upstream side of the second sensor, the controller is capable of driving the upstream side transporting portion so as to transport the following medium to a predetermined standby position on the upstream side of the transporting portion at the time of the overlapping operation, and performing the overlapping transportation control.

In the recording apparatus, the controller may not perform the overlapping transportation control in a case in which an absolute value of a difference obtained by subtracting reference information, which is set in advance with respect to movement information, from the movement information is equal to or greater than a predetermined allowable value, and may perform the overlapping transportation control in a case in which the absolute value of the difference is smaller than the predetermined allowable value.

In a case in which the absolute value of the difference obtained by subtracting the reference information which is set in advance with respect to the movement information from the movement information is great, there is a high possibility that the medium is not transported normally.

In this case, in a case in which the value is equal to or greater than the predetermined allowable value, the controller determines that the medium is abnormally transported and does not perform the overlapping transportation control, and thus it is possible to suppress a failure of the overlapping transportation control.

In the recording apparatus, the movement information may indicate a transporting distance of a medium which is calculated based on an amount of driving of the upstream side transporting portion from detection of the leading end of the preceding medium detected by the second sensor to detection thereof performed by the first sensor, and the reference information may indicate a distance from the detection position detected by the second sensor to the detection position detected by the first sensor which is acquired in advance.

In this case, the controller determines whether or not the overlapping transportation control is performed using the transporting distance of the medium, which is calculated based on an amount of driving the upstream side transporting portion from the detection of the leading end of the preceding medium performed by the second sensor to the detection by the first sensor, as the movement information, and using the distance from the detection position detected by the second sensor to the detection position detected by the first sensor, which is acquired in advance, as reference information.

In the recording apparatus, the controller may set a value obtained by adding the difference to the reference amount of a margin as a new reference amount of a margin in a case in which the difference is greater than zero and the absolute value of the difference is less than the predetermined allowable value.

In this case, a concern that the amount of being overlapped part of the trailing end of the preceding medium and the leading end of the following medium becomes small can be reduced, and a concern on generation of a defect such as the paper jam, reversing of the preceding medium and the following medium upside down, or the like can be reduced.

In the recording apparatus, the controller may set an amount obtained by subtracting the absolute value of the difference from a reference amount of transportation, which is set in advance as an amount of transportation of a medium at the time of performing the overlapping operation, as a new reference amount of transportation, in a case in which the difference is smaller than zero and the absolute value of the difference is less than the predetermined allowable value.

In this case, the following medium is transported at a predetermined distance or more, and thus it is possible to reduce a concern that the following medium may enter and be transported to the transporting portion so as to be overlapped before the recording of the preceding medium is finished.

In the recording apparatus, a value obtained by adding the absolute value of the difference to the reference amount of a margin may be set as a new reference amount of a margin.

Before the continuous-transporting operation is performed, if the upstream side transporting portion is driven so that the following medium is transported to the upstream side by the difference rather than the standby position, when the following medium is transported in a state of transportation similar to the reference information rather than the preceding medium (the difference is minus), the amount of being overlapped part of the trailing end of the preceding medium and the leading end of the following medium becomes small. When the amount of being overlapped becomes small, there is a concern on generation of a defect that the trailing end of the preceding medium and the leading end of the following medium may collide with each other so as to generate the paper jam, reverse overlapped part of the preceding medium and the following medium upside down, or the like.

In this case, even when the following medium is transported in a state of being closer to the reference information than the preceding medium (the difference is minus), it is possible to suppress or avoid a concern on generation of the defect.

In the recording apparatus, the amount of a margin of the trailing end side of the preceding medium being acquired by the controller may be an amount of a margin at the time of finishing recording on the preceding medium which is calculated based on detection information relating to the trailing end of the preceding medium detected by the second sensor.

In this case, since the amount of a margin of the trailing end side of the preceding medium being acquired by the controller is an amount of a margin at the time of finishing recording on the preceding medium which is calculated based on detection information relating to the trailing end of the preceding medium detected by the second sensor, a reliability of determination whether or not the continuous-transporting operation is performed by the controller increases.

In the recording apparatus, the controller may acquire the movement information between the first sensor and the second sensor when the trailing end of the preceding medium and the leading end of the following medium have an interval therebetween.

In this case, it is possible to increase a frequency of performing the overlapping transportation control, and to improve the throughput of the recording process.

In the recording apparatus, the reference information may be updated in accordance with a total number of sheets to be recorded in the apparatus.

When the total number of the sheets to be recorded in the apparatus increases, the absolute value of the difference obtained by subtracting the reference information from the movement information tends to become easily large due to wear of configuration members of various transporting portions such as a roller. When the absolute value of the difference becomes easily large, a frequency of performing the continuous-transporting operation is reduced. Accordingly, the throughput of the recording process may be deteriorated.

In this case, since the reference information can be updated as a value in consideration of the wear or the like of the configuration member in accordance with the total number of the sheets to be recorded in the apparatus, it is possible to suppress deterioration of the throughput of the recording process in accordance with an elapsed time of a use of the recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Example 1

First, a recording apparatus according to an example of the invention will be described. As an example of the recording apparatus, an ink jet printer 1 (hereinafter, simply refer to a printer 1) is exemplified.

Figure 1:
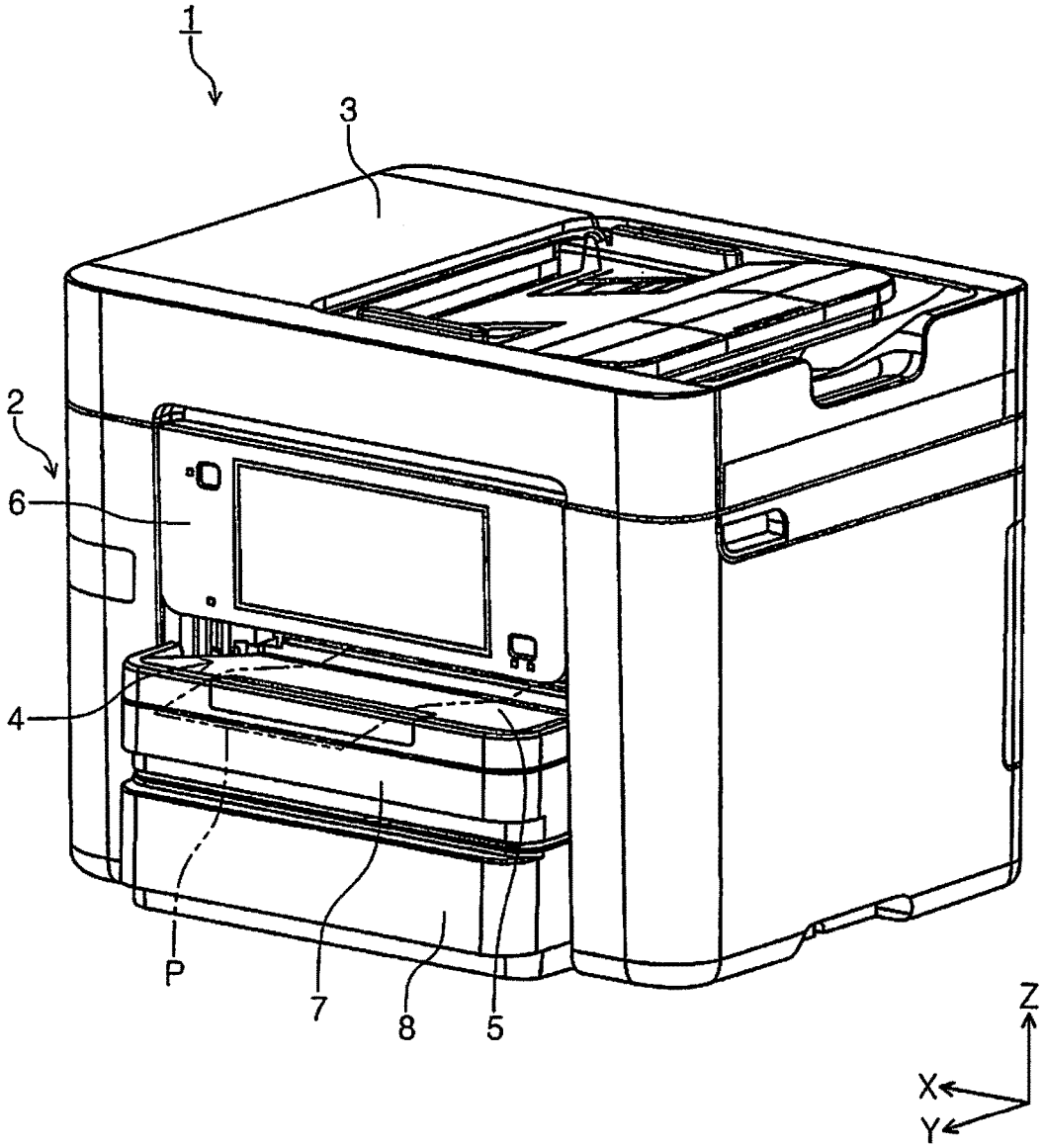
FIG. 1 is a perspective view illustrating an exterior of a printer according to the invention.
Figure 2:
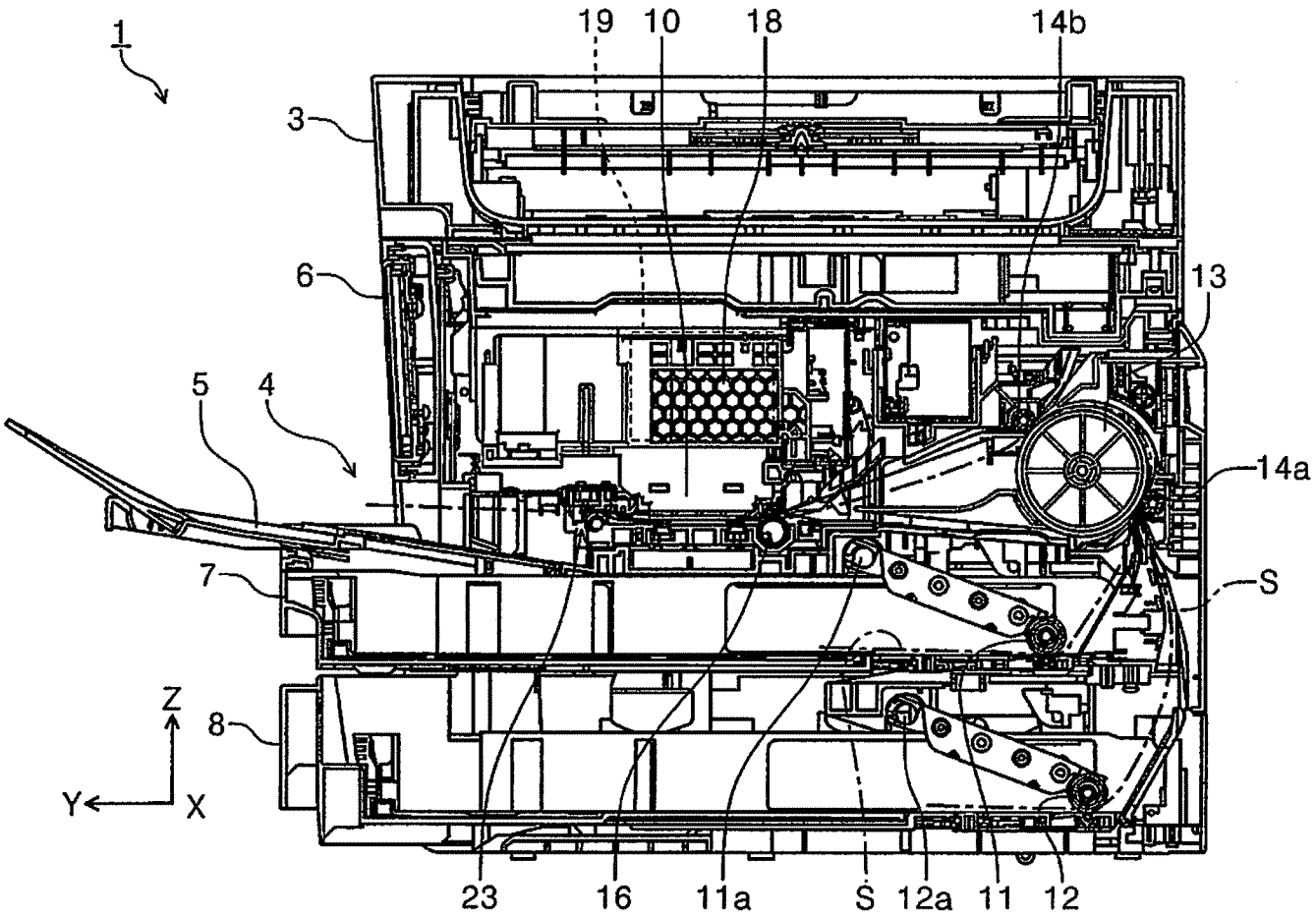
FIG. 2 is a side sectional view of the printer according to the invention.
Figure 3:
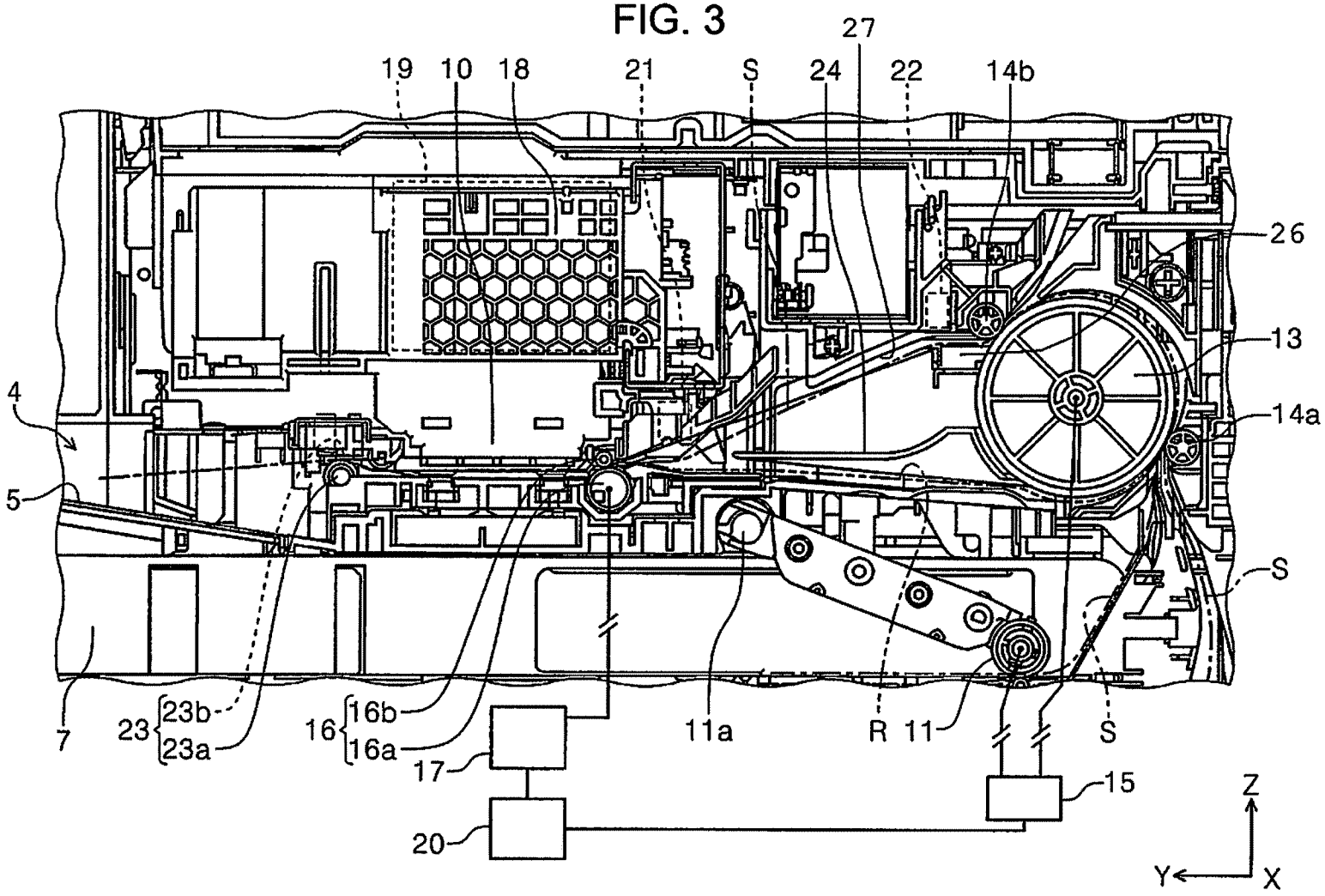
FIG. 3 is a view illustrating a paper transporting passage in the printer according to the invention.
Figure 4:
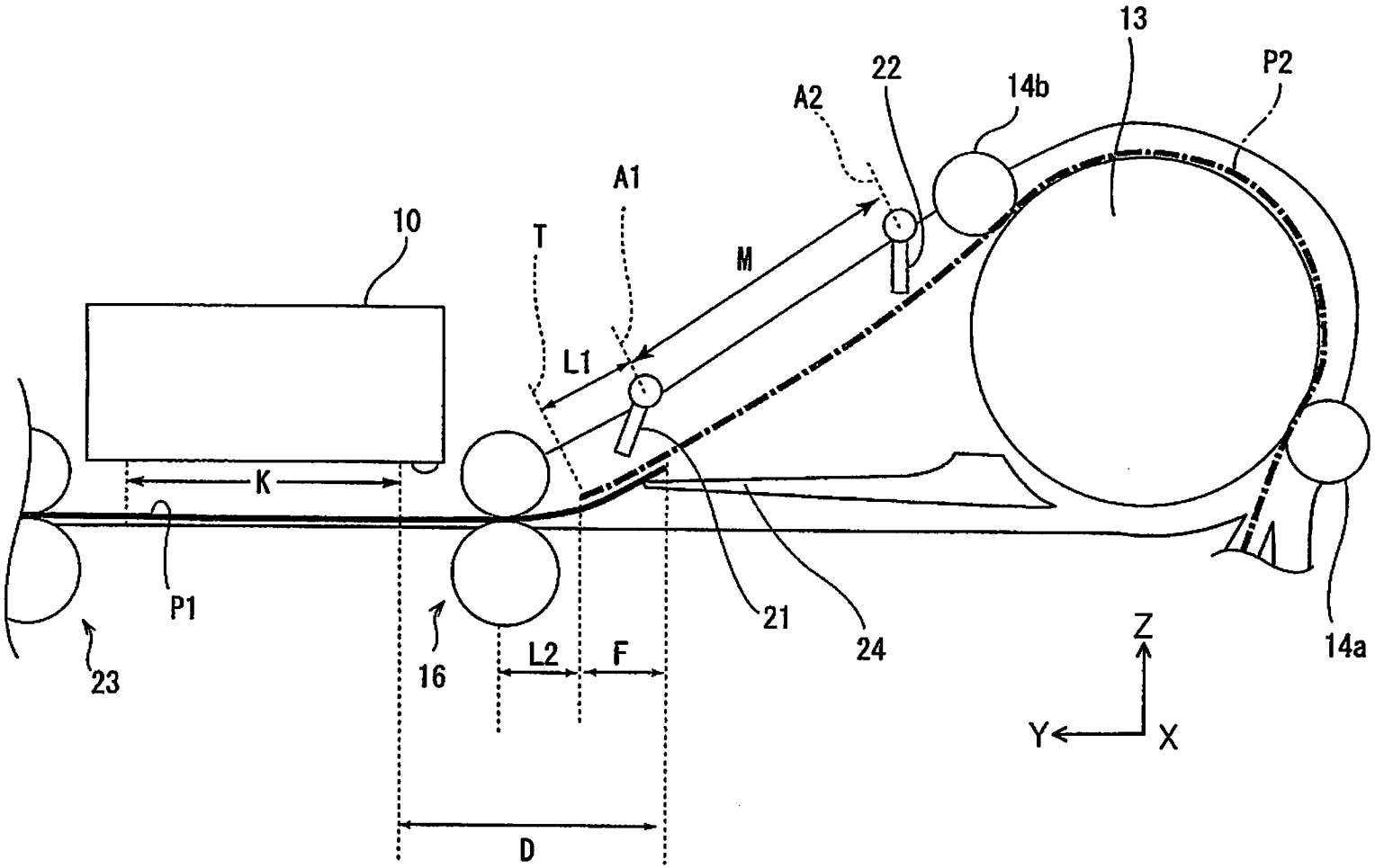
FIG. 4 is a view illustrating an overlapping operation in an overlapping transportation control.
Figure 5:
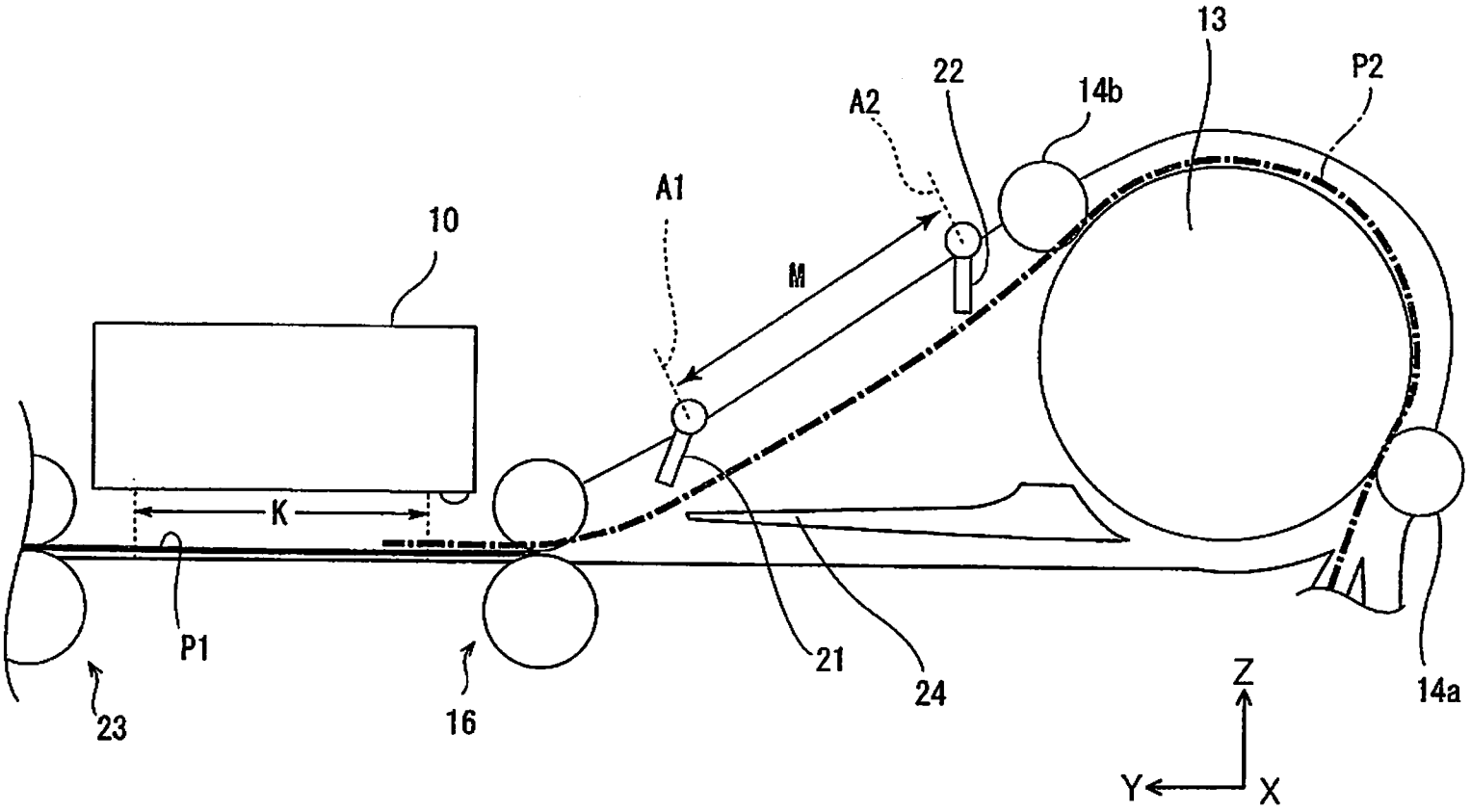
FIG. 5 is a view illustrating a continuous-transporting operation in the overlapping transportation control.
Figure 6:
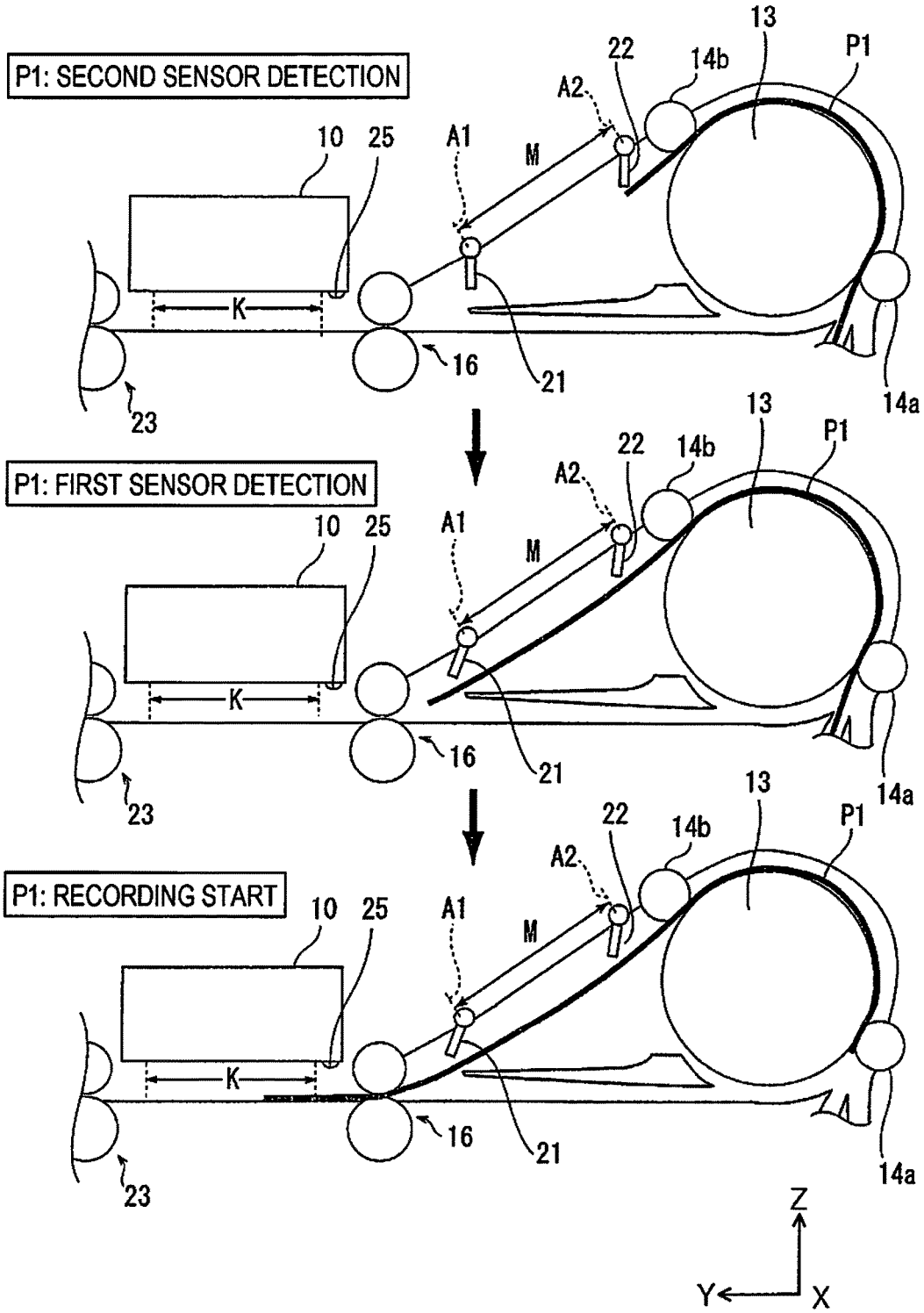
FIG. 6 is a view illustrating the overlapping transportation control.
Figure 7:
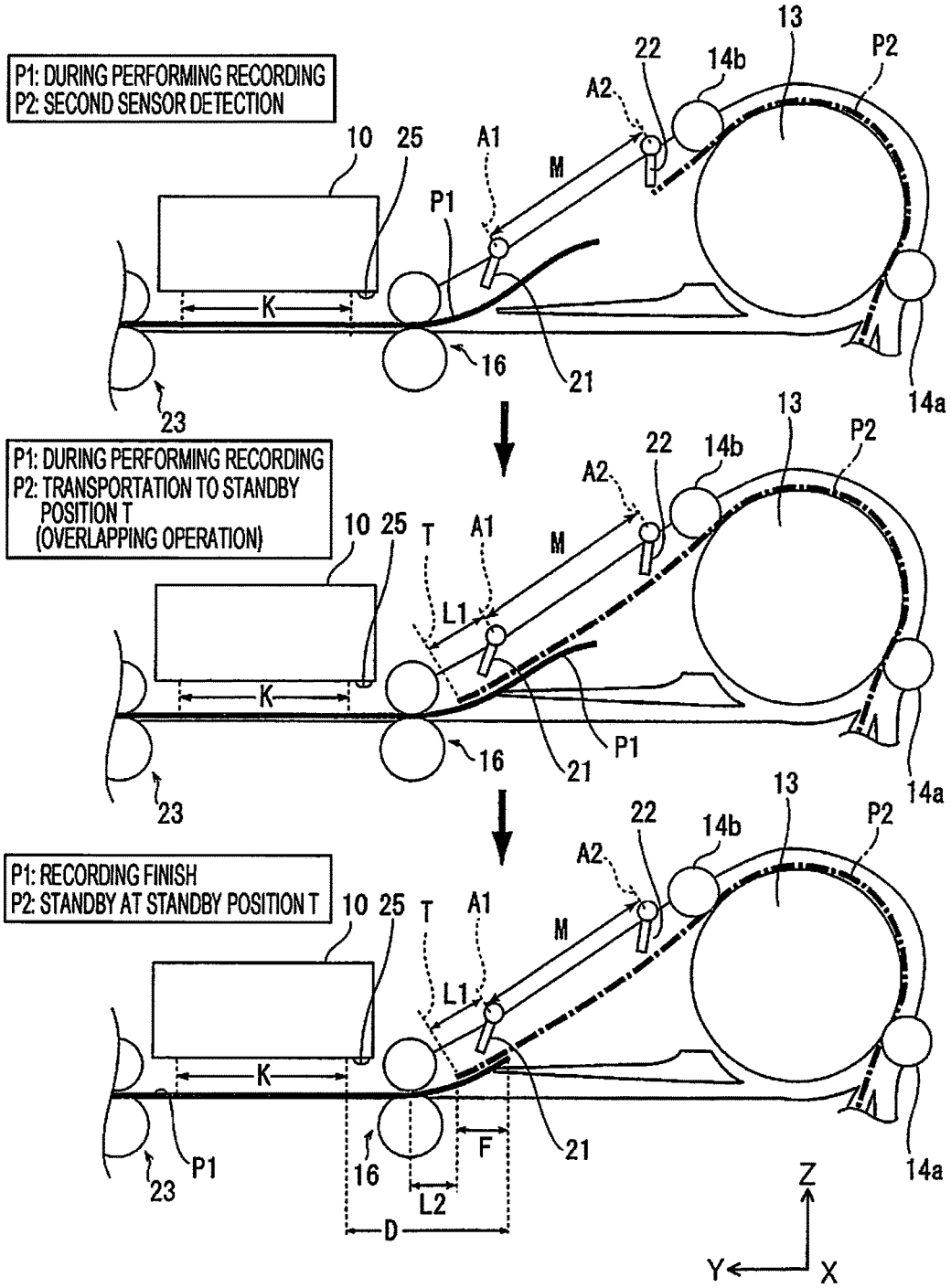
FIG. 7 is a view illustrating the overlapping transportation control.
Figure 8:
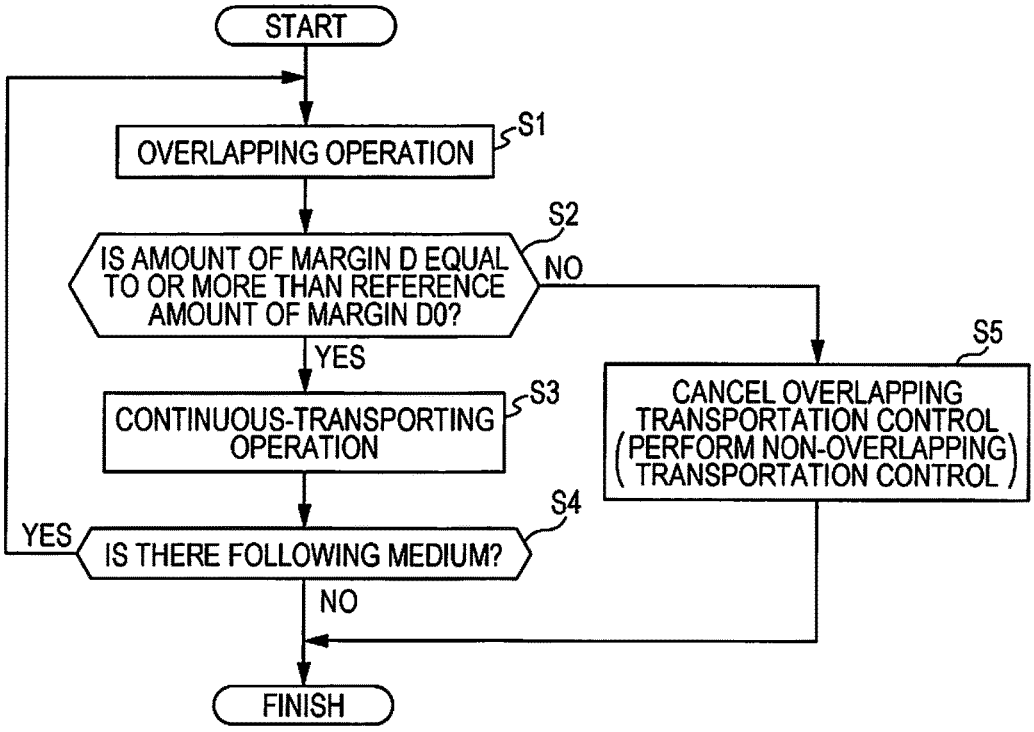
FIG. 8 is a flow chart illustrating an example of the overlapping transportation control.
Figure 9:
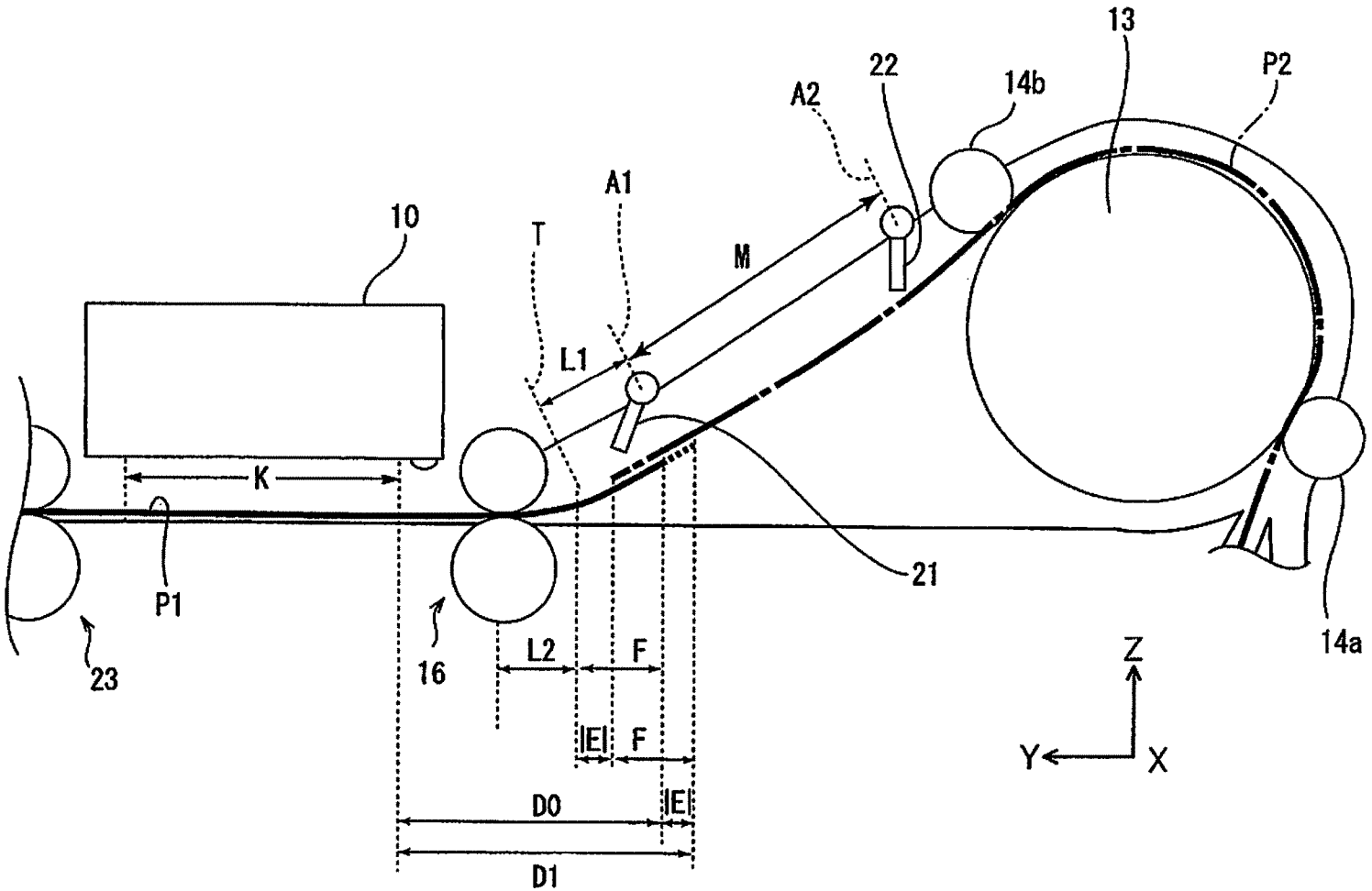
FIG. 9 is a view illustrating the overlapping transportation control based on movement information.
Figure 10:
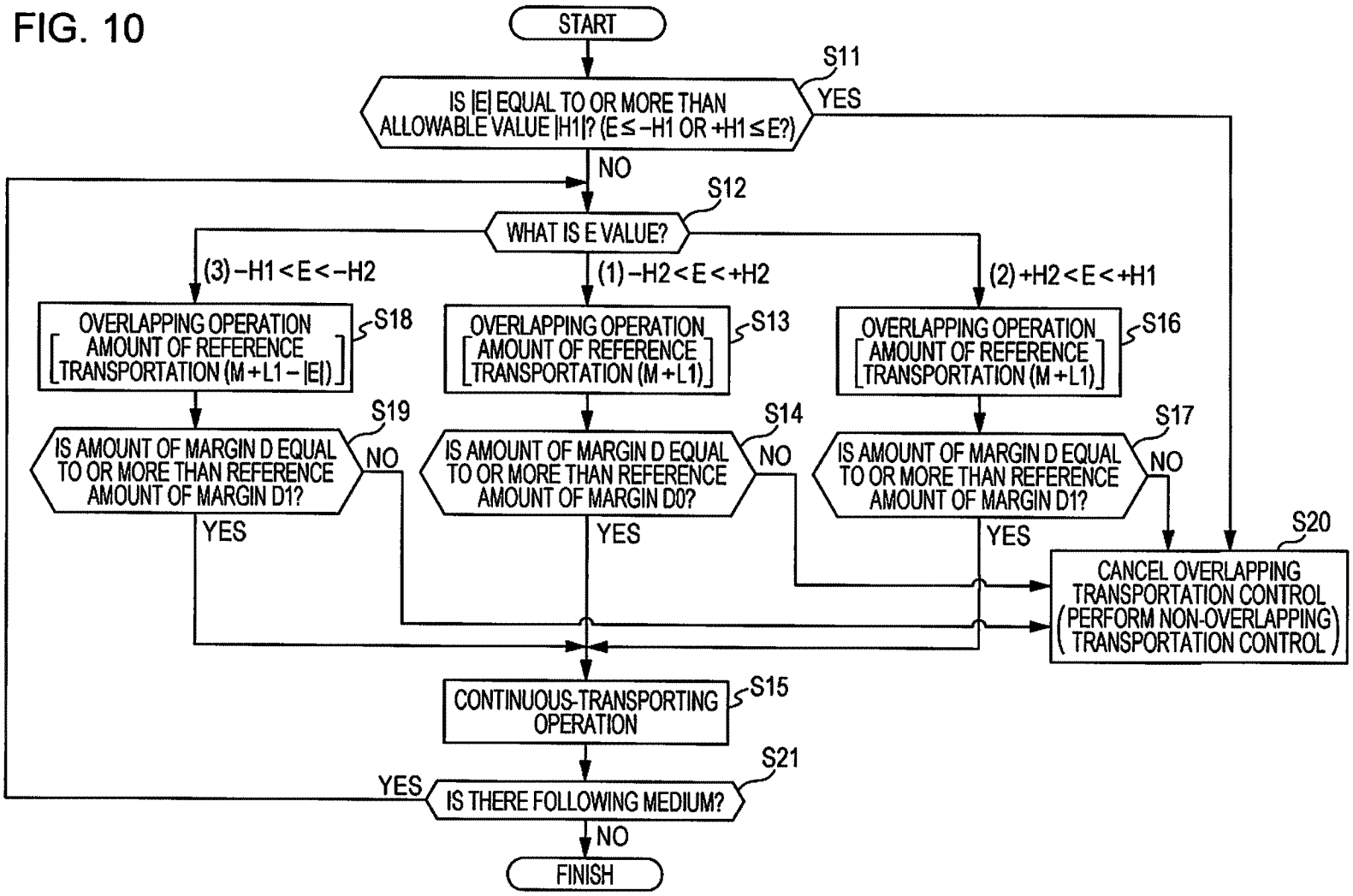
FIG. 10 is a flow chart illustrating an example of the overlapping transportation control based on the movement information.

FIG. 1 is a perspective view illustrating an exterior of a printer according to the invention. FIG. 2 is a side sectional view of the printer according to the invention. FIG. 3 is a view illustrating a paper transporting passage in the printer according to the invention. FIG. 4 is a view illustrating an overlapping operation in an overlapping transportation control. FIG. 5 is a view illustrating a continuous-transporting operation in the overlapping transportation control. FIG. 6 is a view illustrating the overlapping transportation control. FIG. 7 is a view illustrating the overlapping transportation control. FIG. 8 is a flow chart illustrating an example of the overlapping transportation control. FIG. 9 is a view illustrating the overlapping transportation control based on movement information. FIG. 10 is a flow chart illustrating an example of the overlapping transportation control based on the movement information.

Also, regarding an X-Y-Z coordinate system illustrated in each drawing, an X direction is a scanning direction of a recording head, and is also a width direction of a medium where recording is performed. A Y direction is a depth direction of the apparatus, and is also a length direction of the medium. A Z direction is a direction of the gravity, and is also a height direction of the apparatus. In addition, a +Y direction side is set as a front surface side of the apparatus, and a −Y direction side is set as a rear surface side of the apparatus. In addition, a left side seen from the front surface side of the apparatus is set as a +X direction, and a right side thereof is set as a −X direction. In addition, a +Z direction is set as an upper side of the apparatus (including an upper portion, an upper surface, and the like), and a −Z direction side is set as a lower side of the apparatus (including a lower portion, a lower surface, and the like).

In addition, hereinafter, a transporting direction where paper is transported in the printer 1 is referred as a "downstream", and an opposite direction thereto is referred to as an "upstream".

Outline of Printer

The printer 1 (FIG. 1) is configured as a complex machine provided with a printer unit 2 which performs recording on a paper P as a medium and a scanner unit 3 which reads an image of an original document. The scanner unit 3 is provided in an upper portion of the printer unit 2.

As the paper P on which recording is performed by the printer unit 2, plain paper, thick paper, photo paper, and the like are exemplified.

The paper P on which recording is performed by the recording head 10 (FIG. 2) provided inside the printer unit 2 is discharged from a discharge spout 4 which is provided on the front surface of the apparatus in FIG. 1, and is mounted on a paper discharging tray 5.

A reference numeral 6 on the front surface of the apparatus indicates an operation panel which is provided with a power supply button, an operation button for performing various print settings and performing recording, and a display portion displaying print setting contents or a preview of a printed image, and the like.

Regarding Transporting Passage of Paper in Printer

Subsequently, a transporting passage of the paper P will be described with mainly reference to FIGS. 2 and 3 in the printer unit 2. Also, in FIGS. 2 and 3, a one-dot chain line S indicates the transporting passage of the paper.

The printer unit 2 is provided with two-stage paper tray 7 and paper tray 8 which accommodate a plurality of paper pieces on bottom portions thereof, and the paper is fed one by one from either of the paper tray 7 or the paper tray 8.

The paper is once fed to a rear surface side of the apparatus (in the −Y direction) from the paper tray 7 by a first paper feeding roller 11 (also referred to as a pick-up roller), and is bent by an intermediate roller 13 being driven by the first driving source 15 (FIG. 3) so as to be fed to the front surface side of the apparatus (in the +Y direction). In addition, in the same manner, the paper is once fed by the second paper feeding roller 12 from the paper tray 8 to the rear surface side of the apparatus, and is bent by the intermediate roller 13 so as to be fed to the front surface side of the apparatus. Reference numerals 14*a* and 14*b* are a driven roller which is driven and rotated in accordance with rotation of the intermediate roller 13.

The transporting passage of the paper fed from the paper tray 7 and the transporting passage of the paper fed from the paper tray 8 converge in front (upstream side) of a nip point between the intermediate roller 13 and the driven roller 14*a*.

Also, the first paper feeding roller 11 and the second paper feeding roller 12 are configured to be capable of respectively rocking around a rocking shaft 11*a* and a rocking shaft 12*a* as a shaft, and are configured to come into contact with a first paper among a plurality of paper pieces accommodated in the paper tray 7 and the paper tray 8.

In addition, the first paper feeding roller 11 is configured to be driven by the first driving source 15 (FIG. 3) common to the intermediate roller 13. The first driving source 15 is a motor which can be normally rotated and reversely rotated, and for example, when the first driving source 15 is normally driven, both the first paper feeding roller 11 and the intermediate roller 13 are rotated in the transporting direction, but when the first driving source 15 is reversely driven, only the intermediate roller 13 is rotated in the transporting direction. The second paper feeding roller 12 is driven by a driving source (not illustrated) different from the first driving source 15.

When paper is fed from the paper tray 7, both the first paper feeding roller 11 and the intermediate roller 13 are rotated in the transporting direction by normally driving the first driving source 15, and a driving source for the second paper feeding roller 12 is stopped. Meanwhile, when the paper is fed from the paper tray 8, only the intermediate roller 13 is rotated in the transporting direction by reversely driving the first driving source 15, and the driving source for the second paper feeding roller 12 is driven.

The driving of the driving source for the first driving source 15 and the second paper feeding roller 12 are controlled by a controller 20 to be described later (FIG. 3).

In addition, as illustrated in FIG. 3, at a position on a right downstream side of a nip position between the intermediate roller 13 and the driven roller 14*b*, a guide member 26 which guides the paper sent from the nip position and changes a taking-out direction thereof into a target direction is disposed. When the paper is fed, the paper sent from the nip position between the intermediate roller 13 and the driven roller 14*b* is transported obliquely downward along an oblique guide surface 27 while maintaining an upper limit height (FIG. 3). In addition, a supporting member 24 which supports a sagged part in a state in which the fed paper is sagged from the guide member 26, or supports a trailing end portion of the paper after being dropped from the guide member 26 is disposed on a lower side of the guide surface 27.

A pair of the transporting rollers 16 is provided on a downstream side of the intermediate roller 13 as a "transporting portion" which transports the paper. The pair of transporting rollers 16 is provided with a transport-driving roller 16*a* which is rotated and driven by a second driving source 17 (FIG. 3), and a transport-driven roller 16*b* which is driven and rotated in contact with the transport-driving roller 16*a*.

A first sensor 21 (FIG. 3) which detects a position of an end portion of the paper being transported on the upstream side of the pair of transporting rollers 16, and a second sensor 22 (FIG. 3) which detects a position of an end portion of the paper being transported on the upstream side of the first sensor 21 are provided between the intermediate roller 13 and the pair of transporting rollers 16 in the transporting passage of the paper. Also, in the first sensor 21 and the second sensor 22 in the embodiment, a lever type sensor is used, but for example, an optical sensor can be used.

The recording head 10 as a "recording portion" which performs recording on the paper is provided on a downstream side (on a front surface side of the apparatus, and in a +Y axis direction) of the pair of transporting rollers 16. The paper is sent downward the recording head 10 by the pair of transporting rollers 16.

The recording head 10 is held by a carriage 18 which is movable in a width direction (X axis direction) intersecting with a paper transporting direction (Y axis direction), and performs recording by discharging ink as a liquid to the paper which is sent to a recording region K (FIG. 4) by the recording head 10. An ink cartridge 19 which supplies ink to the recording head 10 is mounted in the carriage 18.

In addition, the recording head 10 is provided with a third sensor 25 for detecting a position of an end portion of the transporting direction (Y axis direction) of the paper and a position of an end portion of a width direction (X axis direction) of the paper P. The third sensor 25 is an optical sensor which is provided with a light emitting portion, which is not illustrated, irradiating the paper P with light and a light receiving portion receiving light reflected to the light emitting portion.

A pair of discharging rollers 23 is provided on the downstream side (on the front surface side of the apparatus, and in the +Y direction) of the recording head 10. The pair of discharging rollers 23 is provided with a discharge-driving roller 23*a* and a discharge-driven roller 23*b* which is driven and rotated in contact with the discharge-driving roller 23*a*, and the paper after being recorded is nipped between the discharge-driving roller 23*a* and the discharge-driven roller 23*b* so as to be discharged to the paper discharging tray 5 provided in the front surface side of the apparatus.

Also, the printer 1 is configured to be capable of double-sided printing, and is provided with a switch back passage R illustrated by a two-dot chain line in FIG. 3. The paper in which recording is finished on a front side is sent in the −Y axis direction by reversely rotating the pair of transporting rollers 16 or the pair of discharging rollers 23 so as to pass through the switch back passage R, and is reversed again by being nipped between the intermediate roller 13 and the driven roller 14*a* so as to enter into the transporting passage S. The transporting passage R is a passage passing through a lower side of the supporting member 24 (FIG. 3).

In addition, as illustrated in FIG. 4, the printer 1 is capable of performing an "overlapping transportation" in which the medium is transported by the pair of transporting rollers 16 in a state in which a trailing end of a preceding medium P1, which is precedently transported, is overlapped with a leading end of a following medium P2. The "overlapping transportation" is performed when the controller 20 performs the overlapping transportation control, which includes an "overlapping operation" in which the trailing end of the preceding medium P1 catches up and is overlapped with the following medium P2 on the upstream side of the pair of transporting rollers 16, and a "continuous-transporting operation" in which transportation is performed by the pair of transporting rollers 16 in a state in which the leading end of the following medium P2 is overlapped with the trailing end of the preceding medium P1. Hereinafter, the "overlapping transportation control" being performed by the controller 20 will be described.

Regarding Overlapping Transportation Control

First, with reference to FIGS. 4 to 7, basic operations of the "overlapping transportation control" being performed by the controller 20 will be described.

When the preceding medium P1 (referred to as a first sheet of the paper in this embodiment, for the sake of understanding) is transported by the intermediate roller 13, the leading end of the preceding medium P1 is detected by the second sensor 22 (refer to a top view of FIG. 6).

When the preceding medium P1 is further transported, the leading end of the preceding medium P1 is detected by the first sensor 21 (refer to a middle view of FIG. 6).

The preceding medium P1 passed through a detection position A1 of the first sensor 21 is further transported to the downstream side by the pair of transporting rollers 16. Also, as illustrated in a bottom view of FIG. 6, when the leading end of the preceding medium P1 enters to the recording region K by the recording head 10, recording being performed by the recording head 10 on the preceding medium P1 starts.

The preceding medium P1 is transported to the downstream side by the pair of transporting rollers 16, and recording is performed on the medium. As illustrated in the top view of FIG. 7, after the trailing end of the preceding medium P1 passes through the detection position A2 by the second sensor 22, the following medium P2 is sent by the intermediate roller 13 with an interval with the preceding medium P1. When the leading end of the following medium P2 is detected by the second sensor 22, the controller 20 (FIG. 3) controls the first driving source 15 (FIG. 3) for driving the intermediate roller 13, and performs the "overlapping operation" in which the following medium P2 catches up and is overlapped with the trailing end of the preceding medium P1 (refer to the middle view of FIG. 7).

Specifically, when the leading end of the following medium P2 is detected by the second sensor 22, the controller 20 drives the intermediate roller 13 so that the transportation is performed at a distance obtained by adding a distance M between the first sensor 21 and the second sensor 22 to a predetermined distance L1 as a reference amount of transportation (M+L1). Accordingly, the leading end of the following medium P2 is transported to a standby position T.

The standby position T is set as a position distant away from an upstream side of a distance L2 from the nip point of the pair of transporting rollers 16, and the distance L2 is set as a distance without possibility that the following medium P2 in a standby state may be nipped by the pair of transporting rollers 16. Therefore, a predetermined distance L1 is calculated in advance based on the distance L2 so that the leading end of the following medium P2 is positioned at the standby position T.

The following medium P2 is standby in a state in which the leading end is positioned at the standby position T until recording on the preceding medium P1 is finished. When the recording on the preceding medium P1 is finished (refer to bottom views of FIGS. 7 and 4), the controller 20 drives the intermediate roller 13 and the pair of transporting rollers 16, and performs the "continuous-transporting operation" (FIG. 5) in which transportation is performed by the pair of transporting rollers 16 in a state in which the leading end of the following medium P2 is overlapped with the trailing end of the preceding medium P1.

Also, the "overlapping operation" can be performed when the leading end of the following medium P2 is sent so as to abut on the nip point of the pair of transporting rollers 16 during performing a final pass of the recording of the preceding medium P1 (the pair of transporting rollers 16 stops).

When the "overlapping operation" is performed, the leading end of the following medium cannot be detected by the third sensor 25. Therefore, the following medium P2 is skewed by making the leading end of the following medium P2 abutting on the nip point of the pair of transporting rollers 16 during performing the final pass of the recording of the preceding medium P1, and a position thereof is set as a reference position of the leading end of the following medium P2 so that recording on the following medium P2 can be performed.

In addition, regarding an overlapping method of the "overlapping operation", there are an upper overlapping in which the leading end portion of the following medium P2 is overlapped with an upper side of a trailing end portion of the preceding medium P1, and a lower overlapping in which the leading end portion of the following medium P2 is overlapped with a lower side of the trailing end portion of the preceding medium P1. As the overlapping operation of the embodiment, the upper overlapping is performed. Therefore, the leading end portion of the following medium P2 is necessary to be overlapped with the upper side of the trailing end portion of the preceding medium P1. Here, the guide member 26 causes a sending direction of the paper, which is sent from the nip position between the intermediate roller 13 and the driven roller 14*b*, to be changed into a guide direction near an upper side where the upper overlapping is easily performed, such that the preceding medium P1 and the following medium P2 are overlapped with each other in an appropriate sequence by the overlapping operation. The paper sent from a final nip position (a nip position with the driven roller 14*b*) of the intermediate roller 13 at a predetermined paper feeding speed is changed to be moved in a substantial horizontal direction of an upper side of the sending direction thereof along an upper surface of the guide member 26, such that the paper is transported toward the pair of transporting rollers 16 while the paper after being sent toward the substantial horizontal direction is maintained at an upper limit along the oblique shaped guide surface 27. Accordingly, the upper overlapping in which the following medium P2 is overlapped with the preceding medium P1 from the upper side (recording surface side) succeeds at a higher frequency.

The guide member 26 illustrated in FIG. 3 may be fixed to a posture (for example, a horizontal posture) to be capable of guiding the paper in the sending direction at the time of the overlapping operation, but when the "overlapping operation" is not performed, it is not preferable to give a resistive load to the paper during being transported at the time of changing the sending direction to the upper side. Therefore, the guide member 26 is preferably provided to be enable to be displaced between a guide position (position illustrated in FIG. 3) which is a posture at the time of guiding the paper when performing the "overlapping operation" and a retract position which is a posture not guiding the medium P except that the overlapping operation is performed or a posture where the load that the medium P being guided receives is reduced (not illustrated).

The guide member 26 is provided with, for example, the rocking shaft on a trailing end side (−Y axis direction side) of the guide member 26, and can be displaced in a rocking method of performing rocking between the guide position (refer to FIG. 3) and a retract position (not illustrated) which is a posture in which the leading end of the guide member 26 (an end portion in the +Y axis direction side) is obliquely downward.

In addition, the guide member 26 can be displaced in a slide method of performing sliding between the guide position illustrated in FIG. 3 and the retract position (not illustrated) which is positioned in the −Y axis direction further than the guide position, where the guide member 26 does not protrude in a passage.

In addition, the guide member 26 can be displaced in a method of holding the member at a guide position due to an urging force of a spring (spring load), and displacing the member to the retract position due to the spring load which is weaker than a stiffness of the paper depending on the stiffness of the paper which is strong. For example, an amount of displacement when the guide member 26 which is weaker than the stiffness of the paper is displaced to the retract position is relatively great in a case of paper constituted of thick paper such as photo paper, and the stiffness of the paper is weak in a case of paper constituted of thin paper such as plain paper, and thus the amount of displacement when the guide member 26 is evacuated is relatively small. Accordingly, since the guide member 26 is evacuated due to the amount of displacement as the stiffness of the paper is strong, a load that the paper receives from the guide member 26 can be reduced. Moreover, a mechanism for displacing the guide member 26 using spring loading can be applied to the rocking method or the slide method.

The guide member 26 can be realized using a power source such as a solenoid or an electric motor of course. That is, the guide member 26 is displaced to the guide position and the retract position due to the power of the power source. The mechanism using the power source can be applied to the rocking method or the slide method.

Here, in FIG. 4, the leading end of the following medium P2 is overlapped with a part of margin (a part illustrated by a reference numeral D in FIG. 4) on which recording is not performed on the trailing end side of the preceding medium P1. When the leading end of the following medium P2 is overlapped with the margin of the trailing end of the preceding medium P1 even a little and is transported to the recording region K of the recording head 10, a throughput of a recording process is improved, but in actual, there is a limit to the amount of a margin D that the "overlapping transportation control" can be performed because of reasons for designing such as arrangement of the recording head 10 or the pair of transporting rollers 16.

The limit of the amount of a margin D on which the "overlapping transportation control" can be performed is as follows.

That is, when the amount of a margin D in FIG. 4 becomes small, a remaining part of the upstream side (−Y axis direction side) is reduced more than a nip point of the pair of transporting rollers 16 at the time of finishing the recording on the preceding medium P1. Since the distance L2 is set so that a concern that the following medium P2 in a standby state is nipped by the pair of transporting rollers 16 does not occur, the distance cannot be short. Therefore, when the amount of a margin D is small, an amount of the overlapped part (hereinafter, referred to as an amount of being overlapped F) of the trailing end of the preceding medium P1 and the leading end of the following medium P2 becomes small. When the amount of being overlapped F becomes small, when the "continuous-transporting operation" illustrated in FIG. 5 is performed, there is a concern that the trailing end of the preceding medium P1 and the leading end of the following medium P2 may collide with each other so as to generate a paper jam, or a defect that the overlapped part of the preceding medium P1 and the following medium P2 is reversed upside down.

Therefore, in the embodiment, in a case in which the amount of a margin D of the trailing end of the preceding medium P1 is equal to or more than a reference amount of a margin D0 which is set in advance, the controller 20 performs the "overlapping transportation control". Otherwise, in a case in which the amount of a margin D of the trailing end side of the preceding medium P1 is smaller than the reference amount of a margin D0, the controller 20 does not perform the "overlapping transportation control", but performs a "non-overlapping transportation control" in which transportation is performed with an interval between the trailing end of the preceding medium P1 and the leading end of the following medium P2.

Hereinafter, with reference to the flow chart of FIG. 8, a flow of the "overlapping transportation control" which is performed with reference to the amount of a margin D of the trailing end of the preceding medium P1 will be described.

First, the "overlapping operation (in the middle view of FIG. 7)" of overlapping the leading end of the following medium P2 with the trailing end of the preceding medium P1 (Step S1) is performed. Next to Step S1, the controller 20 determines whether or not the amount of a margin D at the time of finishing the recording on the preceding medium P1 (FIG. 4 and the bottom view of FIG. 7) is equal to or more than the reference amount of a margin D0 (Step S2). In Step S2, in a case in which the amount of a margin D is equal to or more than the reference amount of a margin D0 (YES), the "continuous-transporting operation" is performed (Step S3). In a case in which there is a next following medium next to the following medium P2 (YES in Step S4), the overlapping operation (Step S1) is repeatedly performed on the next following medium. In a case in which there is no next following medium next to the following medium P2 (No in Step S4), the "overlapping transportation control" is finished.

In addition, in Step S2, in a case in which the amount of a margin D is less than the reference amount of a margin D0 (NO), the "overlapping transportation control" is canceled (Step S5). When the "overlapping transportation control" is canceled, the controller 20 performs the "non-overlapping transportation control" in which transportation is performed with an interval between the trailing end of the preceding medium P1 and the leading end of the following medium P2.

As seen from the above, in a case in which the amount of a margin D at the time of finishing the recording on the preceding medium P1 is small, an unreasonable overlapping transportation control is not performed, thereby making it possible to suppress a failure of the "overlapping transportation control".

However, when the reference amount of a margin D0 is set to the lowest value at which the "overlapping transportation control" can be performed at the time of performing the "overlapping operation", that is, two defects to be described below may be generated due to an influence of a transportation accuracy of the intermediate roller 13 when the following medium P2 is transported as illustrated in the top view of FIG. 7 and the middle view of FIG. 7. When the following medium P2 at the time of the "overlapping operation" is transported at a reference amount of transportation (M+L1) or more than, there is a concern that a defect (hereinafter, it may be referred to as a defect (1)) that the following medium P2 is nipped by the pair of transporting rollers 16 and is transported before the recording on the preceding medium P1 is finished may be generated. Adversely, the transporting distance of the following medium P2 is less than the reference amount of transportation (M+L1), the amount of being overlapped F of the trailing end of the preceding medium P1 and the leading end of the following medium P2 becomes small, and there is a concern that a defect (hereinafter, it may referred to as a defect (2)) such as a paper jam in the pair of transporting rollers 16 or reversing the overlapped part of the preceding medium P1 and the following medium P2 upside down at the time of the "continuous-transporting operation" illustrated in FIG. 5 may be generated.

Meanwhile, when the reference amount of a margin D0 is set to be great, the defect (1) or the defect (2) can be avoided, but since a frequency of performing the "overlapping transportation control" is reduced, the throughput of the recording process in the printer 1 is deteriorate.

In order to improve the throughput of the recording process in the printer 1 while suppressing or avoiding such a defect (1) or defect (2) caused by the transportation accuracy of the following medium P2, the controller 20 acquires the movement information relating to movement of the leading end of the preceding medium P1 from the detection position A2 by the second sensor 22 to the detection position A1 by the first sensor 21 illustrated in FIG. 4, and performs the "overlapping transportation control" based on the movement information.

As the movement information, for example, a moving time and a moving speed of the leading end of the preceding medium P1 from the detection position A2 by the second sensor 22 to the detection position A1 by the first sensor 21, and a transporting distance of the preceding medium P1, which are calculated based on an amount of driving the intermediate roller 13, an amount of driving the first driving source 15, an amount of driving the intermediate roller 13, or an amount of driving the first driving source 15, are exemplified. Hereinafter, the "overlapping transportation control" based on the movement information relating to the movement of the leading end of the preceding medium P1 from the detection position A2 to the detection position A1 will be described in detail with a specific example.

Regarding Overlapping Transportation Control based on Movement Information

In the embodiment, as the "movement information", the "transporting distance M1" of the preceding medium P1 which is calculated based on an amount of driving the intermediate roller 13 from the detection of the leading end of the preceding medium P1 by the second sensor 22 to the detection thereof performed by the first sensor 21 is used. The amount of driving the intermediate roller 13 can be, for example, detected by providing an encoder (not illustrated) in the intermediate roller 13. Of course, the encoder (not illustrated) is provided in the first driving source 15, and thus the amount of driving the intermediate roller 13 can be calculated based on an amount of driving the first driving source 15.

The transporting distance M1, which is a calculated value based on the amount of driving the intermediate roller 13, is equal to the distance M (an actual distance from the detection position A2 to the detection position A1) from the detection position A2 by the second sensor 22 to the detection position A1 by the first sensor 21, which is acquired in advance, in a case in which there is no abnormality in the transportation accuracy by the intermediate roller 13 at all. However, the transportation accuracy of the paper P may be changed due to some reasons such as the types or differences of the thicknesses of the paper P being transported or influence of a condition (temperature, humidity, and the like) under which the printer 1 is used. Therefore, there may be a difference between the transporting distance M1 being calculated based on the amount of driving the intermediate roller 13 and the actual distance M from the detection position A2 to the detection position A1. Adversely, the distance M itself may be inappropriate. Specifically, for example, the distance M is acquired in advance in an assembly process of a product, and is stored in a recording unit such as a nonvolatile memory; however, the distance M itself at the time of being acquired in the assembly process may be acquired as an incorrect value, and a difference between the transporting distance M1 and the distance M occurs even in such a case.

Hereinafter, a difference obtained by subtracting the distance M from the transporting distance M1 (the calculated value based on the amount of driving the intermediate roller 13) is set as E (transporting distance M1-distance M=difference E). Also, in the embodiment, the "distance M" from the detection position A2 to the detection position A1 is "reference information" which is set in advance in the assembly process with respect to the transporting distance M1 (the movement information relating to the movement of the leading end of the preceding medium P1 from the detection position A2 to the detection position A1). In addition, hereinafter, an absolute value of the difference E between the transporting distance M1 and the distance M is illustrated as |E|.

Generally, the preceding medium P1 and the following medium P2 at the time of performing continuous-recording are fed from the same paper tray (for example, the paper tray 7 illustrated in FIG. 3), and the types thereof are also the same as each other. Therefore, it is considered that the following medium P2 is transported by the intermediate roller 13 with the transportation accuracy the same as that of the preceding medium P1. From this point, the transportation accuracy based on the transporting distance M1 (movement information) of the leading end of the preceding medium P1 from the detection position A2 to the detection position A1 is considered as the transportation accuracy of the following medium P2 at the time of performing the "overlapping operation (middle view of FIG. 7)", and is controlled by the controller 20. Hereinafter, with reference to a flow chart of FIG. 10, a control in accordance with a value of the difference E between the transporting distance M1 and the distance M will be described.

Initially, the controller 20 determines whether or not the absolute value |E| of the difference E between the transporting distance M1 and the distance M is equal to or greater than an allowable value |H1| (Step S11). In other words, in a case in which the difference E between the transporting distance M1 and the distance M is plus, the controller determines whether or not the difference E is equal to or greater than +H1, and in a case in which the difference E is minus, the controller determines whether or not the difference E is equal to or smaller than −H1. The allowable value |H1| can be set to, for example, approximately 5 mm to 6 mm (5.8 mm in the printer 1 of the embodiment).

Case of |E|≥Allowable Value |H1|

In a case in which the absolute value |E| of the difference E is too large, there is a high possibility that the paper may be not appropriately transported by the intermediate roller 13.

Therefore, the controller 20 determines whether or not the absolute value |E| of the difference E obtained by subtracting the distance M (reference information), which is set in advance with respect to the transporting distance M1, from the transporting distance M1 (the movement information) is equal to or greater than a predetermined allowable value |H1| (Step S11), and cancels the "overlapping transportation control" so as not to be performed (Step S20) in a case in which the absolute value |E| is equal to or greater than the predetermined allowable value |H1| (YES). That is, in a case of E≤−H1 or +H1≤E, a procedure proceeds to Step S20, and the "overlapping transportation control" is canceled.

Accordingly, it is possible to suppress or avoid a concern that the "overlapping transportation control" may be failed. When the "overlapping transportation control" is canceled, the controller 20 performs the "non-overlapping transportation control" in which transportation is performed with an interval between the trailing end of the preceding medium P1 and the leading end of the following medium P2.

Also, the allowable value |H1| can be changed, for example, according to the types of paper of driver information. As an example, in a case in which the paper which has a tendency that the absolute value |E| becomes easily large at the time of transporting is set, the allowable value |H1| can be greater than a case of plain paper. As the paper which has a tendency that the absolute value |E| becomes easily large at the time of transporting, for example, paper (so called thick paper such as exclusive paper which is thicker than plain paper), which is greater than a predetermined basis weight in a curved transporting passage where the transportation is performed in accordance with the curve of the paper by the intermediate roller 13, is considered. That is, a back tension acting on the paper in the curved transporting passage becomes greater as a thickness of the paper increases, and thus it is less likely to be transported than assumed in a case in which the thick paper is transported.

As another example of the paper which has a tendency that the absolute value |E| becomes easily large at the time of transporting, coated paper such as photo paper is considered. That is, since a frictional force, which is generated when the coated surface comes into contact with a transporting roller, becomes smaller than the paper which is not coated, in a case in which the paper which is coated is transported, slippage occurs between the roller and the paper, and it is less likely to be transported than assumed. Also, even in a case in which the coated paper is not paper greater than a predetermined basis weight, the absolute value |E| becomes easily large at the time of transporting.

In Step S11, in a case in which the absolute value |E| is less than the predetermined allowable value |H1| (NO), a procedure proceeds to Step S12. That is, the procedure proceeds to Step S12 in a case of −H1<E<+H1.

In Step S12, in a case in which the difference E is −H1<E<−H1, it is determined whether or not a transportation error is small and a value of the difference E is in a certain range (−H2<E<+H2), and whether or not the different is less than the allowable value |H1| but somewhat the error is greater (in a case of −H1<E<H2 or +H2<E<+H1). Also, |H2| is a value which is smaller than |H1| and is close to zero. For example, the value thereof can be set as approximately 2 mm (2.3 mm in the printer 1 of the embodiment).

Case of (1) −H2<E<+H2

In Step S12, in a case in which (1) −H2<E<+H2 is determined, the transportation accuracy of the preceding medium P1 by the intermediate roller 13 is almost same as planned, and thus the "overlapping operation" in which the intermediate roller 13 transports the following medium P2 from the detection position A2 of the second sensor 22 (FIG. 4) by a reference amount of transportation (M+L1) is once determined to be performed (Step S13). Subsequently, Step S14 for determining whether or not the amount of a margin D at the time of finishing recording on the preceding medium P1 (FIG. 4 and bottom view of FIG. 7) is equal to or more than the reference amount of a margin D0 is performed.

In Step S14, in a case in which the amount of a margin D is equal to or more than the reference amount of a margin D0 (YES), the "continuous-transporting operation (FIG. 5)" is performed (Step S15).

After performing Step S15, in a case in which it is determined that there is no next following medium next to the following medium P2 in Step S21 (NO), the "overlapping transportation control" is finished. In a case in which it is determined that there is a next following medium next to the following medium P2 (YES), the procedure starts again from the "overlapping operation" (Step S13) in a case of (1) −H2<E<+H2.

In addition, in Step S14, in a case in which the amount of a margin D is less than the reference amount of a margin D0 (NO), the "overlapping transportation control" is canceled (Step S20).

Case of (2) +H2<E<+H1

In Step S12, in a case in which the difference E is less than the allowable value |H1| but a value of a plus side (positive number) is determined to have a predetermined error [(2) +H2<E<+H1], the "overlapping operation" in which the intermediate roller 13 transports the following medium P2 from the detection position A2 (FIG. 4) of the second sensor 22 by a reference amount of transportation (M+L1) is performed (Step S16). Here, E is the positive number (E>0), that is, the transporting distance M1 (calculated value)>the distance M (reference information) indicates that the intermediate roller 13 is driven by an amount of driving for transporting the medium at the transporting distance M1 longer than the distance M in order to transport the preceding medium P1 at the distance M. In other words, even when the intermediate roller 13 is driven by the transporting distance M1, the preceding medium P1 is moved by only the distance M.

Therefore, at the time of the "overlapping operation" being performed in Step S16, even when the intermediate roller 13 is driven so that the following medium P2 is transported from the detection position A2 of the second sensor 22 by only the reference amount of transportation (M+L1), the following medium P2 is not moved by a distance smaller than the reference amount of transportation (M+L1), and there is a concern that the leading end of the following medium P2 may not reach the standby position T as illustrated in FIG. 9. In FIG. 9, the leading end of the following medium P2 is positioned on the upstream side by the difference E further than the standby position T. When the leading end of the following medium P2 does not reach the standby position T, the amount of being overlapped of the trailing end of the preceding medium P1 and the leading end of the following medium P2 becomes the amount of being overlapped F1, which is smaller than the amount of being overlapped F at the time of positioning the leading end of the following medium P2 at the standby position T by the difference E, and thus the defect (2) is easily generated.

In order to avoid the defect, in Step S12, in a case in which (2) +H2<E<+H1 is determined, when determination is performed at the time of finishing the recording on the preceding medium P1 based on the amount of a margin D in Step S17 which is performed subsequent to Step S16, a value (D0+E) obtained by adding the difference E to the reference amount of a margin D0 is set as a new reference amount of a margin D1 (FIG. 9). That is, in Step S17, the controller 20 determines whether or not the amount of a margin D at the time of finishing the recording on the preceding medium P1 is equal to or more than the reference amount of a margin D1 (=D0+E). In Step S17, in a case in which the amount of a margin D is determined to be equal to or more than the reference amount of a margin D1 (YES), the "continuous-transporting operation" is performed (Step S15). In addition, in a case in which the amount of a margin D is determined to less than the reference amount of a margin D1 (NO), the "overlapping transportation control" is canceled (Step S20) and is finished.

As seen from the above, as the reference amount of a margin D1 being used in Step S17, the value (D0+|E|) obtained by adding the absolute value |E| of the difference E to the reference amount of a margin D0 is used, in the transportation of the following medium P2 by the intermediate roller 13 at the time of the "overlapping operation", even when there is a transportation error (range of +H2<E<+H1) which is within an allowable range but is too great to ignore, a concern that the amount of being overlapped of the trailing end of the preceding medium P1 and the leading end of the following medium P2 may be reduced, and thus a concern that the defect (2) may be generated can be reduced.

Case of (3) −H1<E<−H2

In Step S12, in a case in which the difference E is less than the allowable value |H1| but a value of a minus side (negative number) is determined to have a predetermined error [(3) −H1<E<−H2], that is, in a case in which it is the transporting distance M1 (calculated value)<the distance M (reference information), it is indicated that, even though the intermediate roller 13 is driven at an amount of driving for transporting the preceding medium P1 by the transporting distance M1 shorter than the distance M, the preceding medium P1 is transported at the distance M. That is, the preceding medium P1 is transported further than planned by the intermediate roller 13. In this case, when the intermediate roller 13 at the time of the "overlapping operation" is driven in the same manner as the case of (1) −H2<E<+H2 or (2) +H2<E<+H1 so that the following medium P2 is transported by the reference amount of transportation (M+L1) from the detection position A2 of the second sensor 22 (FIG. 4), there is a concern that the leading end of the following medium P2 may go beyond the standby position T. When the leading end of the following medium P2 goes beyond the standby position T, there is a concern that the defect (1) that the following medium P2 is transported by the pair of transporting rollers 16 before the recording on the preceding medium P1 is finished may be generated.

Therefore, when (3) −H1<E<−H2 is determined in Step S12, at the time of performing the "overlapping operation" in Step S18, a distance obtained by subtracting a distance (corresponding to the absolute value |E| of the difference E) as the difference E from the general reference amount of transportation (M+L1) is set as a new reference amount of transportation (M+L1−|E|). Therefore, it is possible to reduce a concern that the defect (1) described above caused by the transportation of the following medium P2 at a predetermined distance or more may be generated.

Also, in Step S18, when the amount of transportation by the intermediate roller 13 is set as the reference amount of transportation (M+L1−|E|), the controller 20 causes the intermediate roller 13 to drive at an average driving speed same as that of when performing transporting by the reference amount of transportation (M+L1), but driving of the roller stops faster than when performing the transporting by the reference amount of transportation (M+L1), and thereby making it possible to realize the transportation of the reference amount of transportation (M+L1−|E|).

In addition, as another method, the transportation of the reference amount of transportation (M+L1−|E|) can be realized by reducing the average driving speed of the intermediate roller 13 without changing a driving time of the intermediate roller 13.

After performing Step S18, determination with reference to the amount of a margin D at the time of finishing the recording on the preceding medium P1 is performed (Step S19). Here, in the "overlapping operation" of Step S18, in a case in which the transporting distance of the following medium P2 being transported by the intermediate roller 13 is shortened, if the following medium P2 is transported with a transportation accuracy better than the preceding medium P1 by any reasons, the leading end of the following medium P2 as illustrated in FIG. 9 does not reach the standby position T. That is, in the same manner as the case of (2) +H2<E<+H1, there is a concern that the defect (2) caused by the small amount of being overlapped F1 may be generated.

Therefore, when determination is performed based on the amount of a margin D at the time of finishing recording on the preceding medium P1 in Step S19, the value (D0+|E|) obtained by adding the absolute value |E| of the difference E to the reference amount of a margin D0 is used as a new reference amount of a margin D1 (FIG. 9). That is, in Step S19, the controller 20 determines whether or not the amount of a margin D at the time of finishing the recording on the preceding medium P1 is equal to or more than the reference amount of a margin D1 (=D0+E). In Step S17, in a case in which the amount of a margin D is determined to be equal to or more than the reference amount of a margin D1 (YES), the "continuous-transporting operation" is performed (Step S15), but in a case in which the amount of a margin D is less than the reference amount of a margin D1 (NO), the "overlapping transportation control" is canceled (Step S20) and is finished. When the reference amount of a margin D1 is used as the reference amount of a margin being used in Step S19, even when the following medium P2 is transported with the transportation accuracy better than the preceding medium P1 (−H1<E<−H2) in Step S18, it is possible to suppress or avoid the concern on generation of the defect (2).

As described above, the controller 20 acquires the transporting distance M1 of the leading end of the preceding medium P1, which is movement information relating to movement from the detection position A2 by the second sensor 22 to the detection position A1 by the first sensor 21, and performs the "overlapping transportation control" based on the transporting distance M1, and thus it is possible to suppress or avoid the defect (1) and the defect (2), and to increase a frequency of performing the "continuous-transporting operation" so that the throughput of the recording process is improved.

In addition, the amount of a margin D of the trailing end side of the preceding medium P1 which is acquired and referred by the controller 20 at the time of performing Step S1 (FIG. 8), Step S14, Step S17, and Step S19 (FIG. 10) is calculated based on detection information of the trailing end of the preceding medium P1 by the second sensor 22, and is desirably the amount of a margin at the time of finishing the recording on the preceding medium P1.

As the amount of a margin D, for example, an amount of a margin being planned based on the driver information (including driver information of a computer or the like being connected to the printer 1) of the printer 1 can be used, but in a case in which information such as a size of paper set in the driver is wrong, the planned amount of a margin and the actual amount of a margin may be widely different from each other.

An amount of a margin being calculated based on the actual medium detection information (detection information by the second sensor 22) before the recording on the preceding medium P1 is finished is used as the amount of a margin D, and thus a certainty of determination by the controller 20 increases.

In addition, in the "overlapping transportation control", when a first sheet of paper as the preceding medium P1 passes through the second sensor 22 and the first sensor 21, the transporting distance M1 (the movement information) is acquired, and a second, a third and a next sheet of the paper are capable of continuously passing therethrough; however, for example, in a case in which the "overlapping transportation control" is canceled and the "non-overlapping transportation control" is performed, it is good to use the first sheet of the paper being transported as the preceding medium P1 after the "non-overlapping transportation control" so as to acquire a new transporting distance M1 (movement information), and to perform the "overlapping transportation control" based on the new transporting distance M1.

Accordingly, a frequency of performing the "overlapping transportation control" increases, and thus the throughput of the recording process can be improved. In addition, when the "overlapping transportation control" restarts, the transporting distance M1 of the paper (preceding medium P1) immediately before restarting the overlapping transportation control is acquired again, and thus generation of the defect (1) and the defect (2) in the "overlapping transportation control" after restarting can be effectively suppressed.

In addition, after the transporting distance M1 (movement information) of the first sheet of the paper as the preceding medium P1 is acquired, in a case in which the "overlapping transportation control" is successively performed on the paper more than a predetermined number of sheets (for example, five), even when there is the amount of a margin D where the "overlapping transportation control" can be performed on a sixth sheet of the paper, once the "overlapping transportation control" is finished, and the "non-overlapping transportation control" can be performed. Also, when the "overlapping transportation control" restarts after the "non-overlapping transportation control", the transporting distance M1 is acquired again.

Accordingly, the transporting distance M1 is acquired again and updated every time when the continuous-transporting operation is performed at a predetermined number of the paper, and thus it is possible to effectively suppress generation of the defect (1) and the defect (2) in the "overlapping transportation control".

In addition, the distance M (reference information) which is set in advance with respect to the transporting distance M1 (movement information) is preferably updated in accordance with a use of the printer 1. For example, the distance M can be updated in accordance of a total number of sheets to be recorded in the printer 1.

When the total number of the sheets to be recorded in the printer 1 increases, the absolute value |E| of the difference E obtained by subtracting the distance M from the transporting distance M1 tends to increase due to wear or the like of the intermediate roller 13. When there are many cases of increasing of the absolute value |E|, in Step S11 of FIG. 10, the absolute value |E| is determined to exceed the allowable value |H1|, there are many cases in which the "overlapping transportation control" is canceled, and a frequency of performing the "continuous-transporting operation" is reduced. Accordingly, the throughput of the recording process may be deteriorated.

Therefore, in each of a predetermined number of the sheet to be recorded, the distance M (reference information) is updated in consideration of the wear or the like of the intermediate roller 13 in accordance with the total number of the sheets to be recorded in the printer 1, and thus it is possible to suppress deterioration of the throughput of the recording process by a use in accordance with elapsed time of the printer 1.

A timing of updating the distance M (reference information) is not limited to a timing when recording is performed the predetermined total number of the sheets to be recorded, and for example, the distance M (reference information) may be updated when an average value of the absolute value |E| at the time of performing the "overlapping transportation control" a predetermined number of times exceeds a predetermined value. At this time, an average value of the transporting distance M1 at the time of performing the "overlapping transportation control" a predetermined number of times can be set as the distance M as new reference information.

Also, the invention is not limited to the above-described embodiment, various modifications are possible within the scope of the invention described in claims, and it is needless to say that the modifications are also included in within the scope of the invention.

The entire disclosure of Japanese Patent Application No.:2017-055971, filed on Mar. 22, 2017 is expressly incorporated by reference herein.

What is claimed is:

1. A recording apparatus comprising:

a transporting portion that transports a medium;

a recording portion that is positioned on a downstream side of the transporting portion, and performs recording on the medium being transported;

a first sensor that detects a position of an end portion of the medium in a transporting direction which is transported on an upstream side of the transporting portion;

a second sensor that detects a position of an end portion of the medium in the transporting direction which is transported on an upstream side of the first sensor; and a controller that is capable of performing an overlapping transportation control including an overlapping operation in which a following medium catches up with a trailing end of a preceding medium which is precedently transported so as to be overlapped with the trailing end of the preceding medium on the upstream side of the transporting portion, and a continuous-transporting operation in which the mediums are transported by the transporting portion in a state in which a leading end of the following medium is overlapped with the trailing end of the preceding medium, wherein the controller acquires movement information relating to movement of a leading end of the preceding medium from a detection position detected by the second sensor to a detection position detected by the first sensor, and performs the overlapping transportation control based on the movement information.

2. The recording apparatus according to claim 1, wherein the controller performs a non-overlapping transportation control in which the mediums are transported with an interval between the trailing end of the preceding medium and the leading end of the following medium without performing the overlapping transportation control in a case in which an amount of a margin of a trailing end side of the preceding medium is smaller than a reference amount of a margin which is set in advance.

3. The recording apparatus according to claim 2, further comprising:

an upstream side transporting portion that transports a medium to an upstream side of the second sensor, wherein the controller drives the upstream side transporting portion so that the following medium is transported to a predetermined standby position on the upstream side of the transporting portion at the time of the overlapping operation.

4. The recording apparatus according to claim 3, wherein the controller does not perform the overlapping transportation control in a case in which an absolute value of a difference obtained by subtracting reference information, which is set in advance with respect to movement information, from the movement information is equal to or greater than a predetermined allowable value, and performs the overlapping transportation control in a case in which the absolute value of the difference is smaller than the predetermined allowable value.

5. The recording apparatus according to claim 4, wherein the movement information indicates a transporting distance of a medium which is calculated based on an amount of driving of the upstream side transporting portion from detection of the leading end of the preceding medium performed by the second sensor to detection thereof performed by the first sensor, and wherein the reference information indicates a distance from the detection position detected by the second sensor to the detection position detected by the first sensor which is acquired in advance.

6. The recording apparatus according to claim 5, wherein the controller sets a value obtained by adding the difference to the reference amount of a margin as a new reference amount of a margin in a case in which the difference is greater than zero and the absolute value of the difference is less than the predetermined allowable value.

7. The recording apparatus according to claim 5, wherein the controller sets an amount obtained by subtracting the absolute value of the difference from a reference amount of transportation, which is set in advance as an amount of transportation of a medium at the time of performing the overlapping operation, as a new reference amount of transportation, in a case in which the difference is smaller than zero and the absolute value of the difference is less than the predetermined allowable value.

8. The recording apparatus according to claim 7, wherein a value obtained by adding the absolute value of the difference to the reference amount of a margin is set as a new reference amount of a margin.

9. The recording apparatus according to claim 2, wherein the amount of a margin of the trailing end side of the preceding medium being acquired by the controller is an amount of a margin at the time of finishing recording on the preceding medium which is calculated based on detection information relating to the trailing end of the preceding medium detected by the second sensor.

10. The recording apparatus according to claim 1, wherein the controller acquires the movement information between the first sensor and the second sensor when the trailing end of the preceding medium and the leading end of the following medium have an interval therebetween.

11. The recording apparatus according to claim 4, wherein the reference information is updated in accordance with a total number of sheets to be recorded in the apparatus.

* * * * *